US012030704B2

(12) United States Patent
Lewis et al.

(10) Patent No.: US 12,030,704 B2
(45) Date of Patent: Jul. 9, 2024

(54) PACKAGING FOR TOBACCO INDUSTRY PRODUCTS

(71) Applicant: British American Tobacco (Investments) Limited, London (GB)

(72) Inventors: Stephen Lewis, London (GB); Paul Matthews, London (GB); Mustafa Isaak Ghulam, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 18/093,545

(22) Filed: Jan. 5, 2023

(65) Prior Publication Data

US 2023/0150744 A1 May 18, 2023

Related U.S. Application Data

(62) Division of application No. 17/265,620, filed as application No. PCT/GB2019/052340 on Aug. 21, 2019, now Pat. No. 11,565,865.

(30) Foreign Application Priority Data

Aug. 23, 2018 (GB) ..... 1813734
Nov. 23, 2018 (GB) ..... 1819133

(51) Int. Cl.
*B65D 75/58* (2006.01)
*B65D 77/00* (2006.01)
*B65D 85/10* (2006.01)

(52) U.S. Cl.
CPC ..... *B65D 75/5844* (2013.01); *B65D 77/003* (2013.01); *B65D 85/1045* (2013.01); *B65D 2401/10* (2020.05); *B65D 2401/55* (2020.05)

(58) Field of Classification Search
CPC ..... B65D 5/42; B65D 75/58; B65D 75/5844; B65D 77/00; B65D 77/003; B65D 85/10;
(Continued)

(56) References Cited

U.S. PATENT DOCUMENTS 4,718,553 A 1/1988 Adamoli
4,911,302 A 3/1990 Butler
(Continued)

FOREIGN PATENT DOCUMENTS

EP 0803450 A1 10/1997
EP 1995183 A1 11/2008
(Continued)

OTHER PUBLICATIONS

Canadian Office Action for corresponding application 3,110,133; Office Action dated May 19, 2022.
(Continued)

*Primary Examiner* — Bryon P Gehman
(74) *Attorney, Agent, or Firm* — CANTOR COLBURN LLP

(57) ABSTRACT

Packaging for tobacco industry products is disclosed. The packaging comprises a pack for holding tobacco industry products, and an outer wrapper enveloping the pack. The outer wrapper comprises a removable portion arranged to prevent opening of the pack until the removable portion has been removed. One of the pack and the removable portion comprises a tamper evident feature that remains attached to the other of the pack or the removable portion after the removable portion is removed from the pack. A method of packaging tobacco industry products is also disclosed.

8 Claims, 5 Drawing Sheets

(58) Field of Classification Search
CPC ..... B65D 85/1036; B65D 85/1045; B65D 2401/10; B65D 2401/55
USPC ..... 206/242, 264–268, 271–275
See application file for complete search history.

(56) References Cited

U.S. PATENT DOCUMENTS

| | | | | |
|---|---|---|---|---|
| 10,173,832 | B2 | 1/2019 | Chatelain | |
| 2004/0118713 | A1 | 6/2004 | Fath | |
| 2017/0137209 | A1* | 5/2017 | Cavallari | B31B 50/60 |

FOREIGN PATENT DOCUMENTS

| | | | |
|---|---|---|---|
| GB | 2493905 | A | 8/2011 |
| GB | 2493836 | A | 2/2013 |
| RU | 2765199 | C1 | 1/2022 |
| WO | 2011022248 | A1 | 2/2011 |
| WO | 2013120756 | A1 | 8/2013 |
| WO | 2014146957 | A1 | 9/2014 |
| WO | 2015162729 | A1 | 10/2015 |
| WO | 2016126424 | A1 | 8/2016 |

OTHER PUBLICATIONS

International Search Report for corresponding application PCT/GB2019/052340 filed Aug. 21, 2019; dated Dec. 12, 2019.
Japanese Office Action for JP application No. 2021-509817; Report dated Aug. 29, 2022.
Written Opinion of the International Searching Authority for corresponding application PCT/GB2019/052340 filed Aug. 21, 2019; dated Dec. 12, 2019.

* cited by examiner

PACKAGING FOR TOBACCO INDUSTRY PRODUCTS

CROSS REFERENCE TO RELATED APPLICATIONS

This application is a divisional of U.S. patent application Ser. No. 17/265,620, which was filed on Feb. 3, 2021 as the U.S. National Stage of International Patent Application Number PCT/GB2019/052340, which was filed on Aug. 21, 2019 claiming priority to Great Britain Patent Application Number 1813734.9 filed on Aug. 23, 2018 and Great Britain Patent Application Number 1819133.8 filed on Nov. 23, 2018, all of which said applications are hereby incorporated by reference in their entirety.

FIELD

The present invention relates to packaging for tobacco industry products, for example cigarettes.

BACKGROUND

Known hinged-lid cigarette packs include a tax stamp that is adhered to the pack overlying a closure line between the hinged-lid and the body of the pack. The tax stamp includes a line of perforations aligned with the lid closure line, such that on opening the hinged-lid the tax stamp is broken, providing tamper evidence.

SUMMARY

In accordance with embodiments of the invention, there is provided packaging for tobacco industry products, the packaging comprising a pack for holding tobacco industry products, and an outer wrapper enveloping the pack, the outer wrapper comprising a removable portion arranged to prevent opening of the pack until the removable portion has been removed, wherein one of the pack and the removable portion comprises a tamper evident feature that remains attached to the other of the pack or the removable portion after the removable portion is removed from the pack.

In examples, the outer wrapper is attached to the pack at the tamper evident feature. In examples, the outer wrapper is attached directly to the pack at the tamper evident feature. For example, the outer wrapper may be attached to a surface of the pack at the tamper evident feature. The surface of the pack may be a printed surface of the pack itself, without additional label or intermediate component.

The removable portion of the outer wrapper may comprise a tear tape arranged to facilitate removal of the removable portion. In some examples, the tear tape is attached to the pack at a location along the tear tape.

In some examples, the tear tape comprises the tamper evident feature, the tamper evident feature being a detachable portion of the tear tape that is attached to the pack such that the detachable portion remains attached to the pack on removal of the removable portion.

The detachable portion of the tear tape may comprise an enlarged portion of the tear tape and a line of weakness defining a boundary between the detachable portion and the remainder of the tear tape.

In some examples, the pack may comprise the tamper evident feature. For example, the tamper evident feature may be a detachable portion on the pack, the detachable portion being adhered to the removable portion of the outer wrapper so that the detachable portion is detached from the pack on removal of the removable portion from the pack.

The detachable portion may be defined by a line of weakness in the pack, for example a line of perforations. Alternatively, the detachable portion may be defined by an alternative line of weakness in the pack, for example a score line. The detachable portion may be defined by a plurality of lines of weakness in the pack. The detachable portion may comprise a surface layer of the pack. Alternatively, the detachable portion may include the full thickness of the pack within the detachable portion.

The pack may comprise an indicium located underneath the detachable portion so that the indicium is exposed on detachment of the detachable portion.

In examples where the removable portion of the outer wrapper comprises a tear tape, the detachable portion may be attached to a location along the tear tape.

In some examples, the pack comprises a body and a lid that together define a parallelepiped pack having a front face, a rear face, and opposing side faces. The lid may be hingedly attached to the body at a hinge extending across the rear face of the pack. In preferred examples, the tamper evident feature may be disposed on an opposing side face of the pack.

The lid and the body of the pack may meet at a lid closure line, and the tamper evident feature may be disposed adjacent the lid closure line on the opposing side face of the pack.

The pack may further comprise opposing end faces, and the lid closure line in the opposing side faces of the pack may be angled with respect to the opposing end faces.

In some examples, the tamper evident feature may comprise a heat activated ink that is printed on a surface of the pack underlying the removable portion of the outer wrapper.

The heat activated ink may be attached to the removable portion of the outer wrapper such that the heat activated ink is removed from the pack with the removable portion of the outer wrapper.

The outer wrapper may be heat sealed about the pack. In this example, the heat activated ink may be disposed underneath a heat sealed area of the outer wrapper such that forming the heat seals in the outer wrapper causes the heat activated ink to be attached to the outer wrapper.

The heat activated ink may be printed in an indicium.

The indicium may have a colour and may be printed in an area having an identical or similar colour such that removal of the heat activated ink from the pack creates an indicium by the absence of the heat activated ink on the pack.

In another example, the packaging may further comprise a release layer disposed underneath the heat activated ink. The release layer may be printed in a negative of an indicium. In this way, on removal of the removable portion of the outer wrapper from the pack heat activated ink is removed from the pack in areas of the release layer, leaving some heat activated ink on the pack in the form of an indicium.

The release layer may be printed with spared out areas where no release layer is provided. The spared out areas may form an indicium. The release layer may comprise a varnish.

The indicium may be text, for example text stating "Pack Opened".

The removable portion of the outer wrapper may cover an end face of the pack. The heat activated ink may be disposed on the end face of the pack.

According to a further aspect of the invention, there is also provided a method of packaging tobacco industry products, the method comprising:

providing a heat activated ink on a pack of tobacco industry products, wrapping an outer wrapper about the pack of tobacco industry products, and heat sealing the outer wrapper at a location coinciding with the heat activated ink such that the outer wrapper is attached to the pack by the heat activated ink.

BRIEF DESCRIPTION OF THE DRAWINGS

Embodiments of the invention will now be described, by way of example only, with reference to the accompanying drawings, in which.

DETAILED DESCRIPTION

Figure 1:
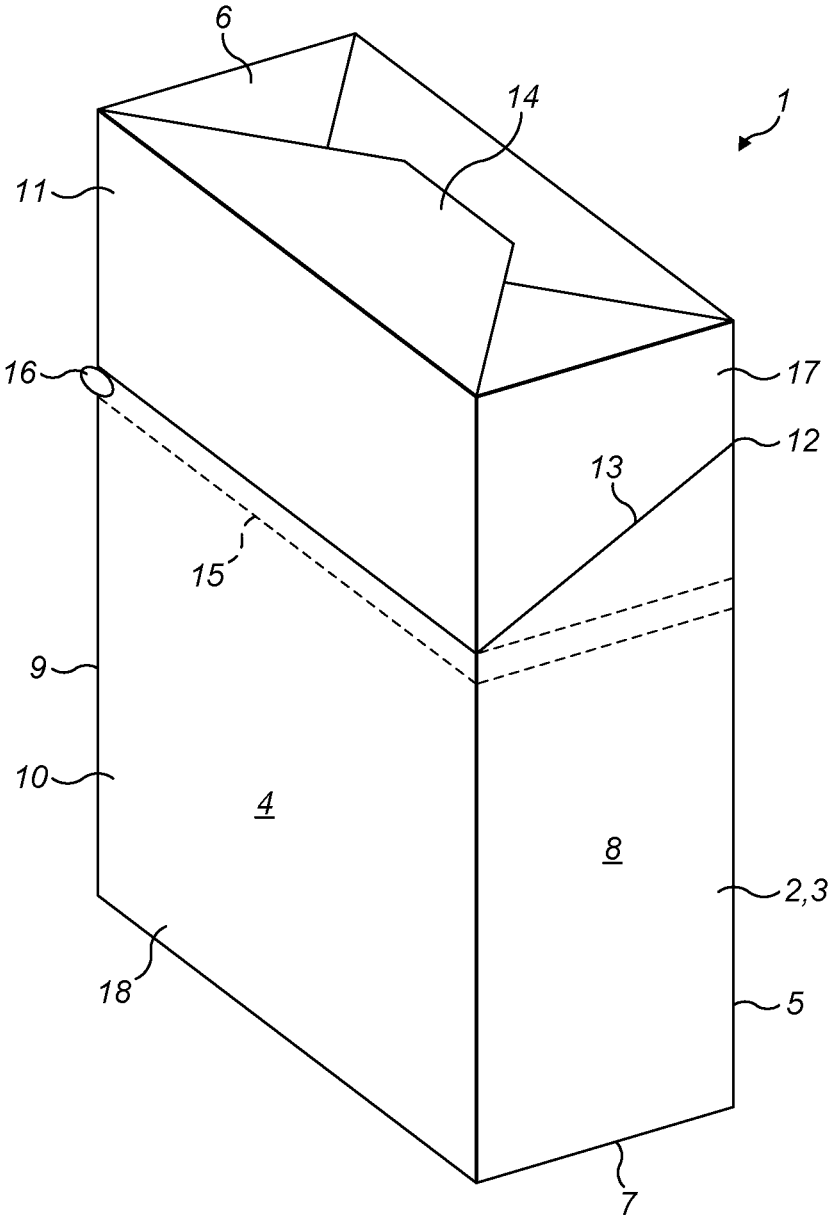
FIG. 1 shows packaging for tobacco industry products.

The packaging 1 in FIG. 1 is for tobacco industry products, such as cigarettes. However, it will be appreciated that the packaging 1 depicted and described herein may be used for other tobacco industry products.

As shown, the packaging 1 includes a hinged-lid pack 2 and an outer wrapper 3. The hinged-lid pack 2 is parallelepiped, having a front face 4, a rear face 5, opposing end faces 6, 7, and opposing side faces 8, 9. The hinged-lid pack 2 has a body 10 and a lid 11 that is hingedly attached to the body 10, the body 10 and the lid 11 together in the closed position are a parallelepiped, as illustrated.

A hinge 12 is formed across the rear face 5 of the pack 2, and a lid closure line 13 extends through the opposing side faces 8, 9 and across the front face 4 to delimit the lid 11 from the body 10. In this way, the lid 11 can pivot open about the hinge 12 to provide access to the contents held in the hinged-lid pack 2. The lid closure line 13 in the opposing side faces 8, 9 is diagonal relative to the opposing end faces 6, 7. The hinge 12 is located closer to the end face 6 formed in the lid 11 than the lid closure line 13 extending across the front face 4.

The hinged-lid pack 2 is preferably made of card, for example a laminated and/or printed card material. The hinged-lid pack 2 can be constructed from a card blank which is folded about the contents and glued to provide the illustrated hinged-lid pack 2.

The outer wrapper 3 envelopes the hinged-lid pack 2 and provides additional sealing as well as tamper evidence (i.e. evidence of whether or not the pack 2 has been previously opened).

The outer wrapper 3 is preferably formed of a flexible polymer material, for example oriented polypropylene film. However in other examples the outer wrapper 3 can be made from an alternative polymer material, such as a cellulose film, a polyethylene film, a polyethylene terephthalate film, or other film. Alternatively, the outer wrapper 3 may comprise a paper material, or a foil material, or a laminate that includes several different materials such as a foil and polymer laminate. The outer wrapper 3 may be printed. The outer wrapper 3 may be transparent.

The outer wrapper 3 is wrapped and sealed about the hinged-lid pack 2. A seam (not shown) is formed in the outer wrapper 3 along one of the opposing side faces 8, 9 of the hinged-lid pack 2. Additionally, heat seals 14 are provided in the outer wrapper 3 on the opposing end faces 6, 7 of the hinged-lid pack 2. The heat seal 14 in the end face 6 formed in the lid 11 is illustrated in FIG. 1, where the outer wrapper 3 is folded flat against the end face 6 of the hinged-lid pack 2 and then heat sealed to itself to hold it in position.

The outer wrapper 3 comprises a tear tape 15. The tear tape 15 extends about the hinged-lid pack 2 and can be used to divide the outer wrapper 3 into two parts, allowing at least one part to be removed to provide access to the hinged-lid pack 2. In this example, the tear tape 15 is disposed adjacent to the lid closure line 13 on the front face 4 of the hinged-lid pack 2 and extends about the opposing side faces 8, 9 and across the rear face 5 at an equal distance from the opposing end faces 6, 7 (i.e. parallel to the opposing end faces 6, 7). The tear tape 15 includes a gripping tab 16 for a user to grip and pull. As the user pulls the gripping tab 16 the tear tape 15 separates the outer wrapper 3 into two parts. The tear tape facilitates tearing of the outer wrapper 3 along the line of the tear tape 15, dividing the outer wrapper 3 into two parts.

The part of the outer wrapper 3 that covers the lid 11 before opening is a removable portion 17 that is removed by use of the tear tape 15, allowing the lid 11 to pivot open. The other part 18 of the outer wrapper 3 may remain surrounding the body 10 of the pack 2.

It will be appreciated that the hinged-lid type packaging for tobacco industry products shown in FIG. 1 is only one example, and the present invention may be applied to other types of packaging, for example packs that open by sliding one part relative to another, or packs that open by twisting one part relative to another. In these examples, the packs are still provided with an outer wrapper that includes a removable portion that prevents opening of pack until the removable portion is removed, for example by use of a tear tape.

The examples described hereinafter relate to tamper evident features for use on the packaging 1 described with reference to FIG. 1. However, it will be appreciated that the tamper evident features described hereinafter can be used on other types of packaging for tobacco industry products, for example those mentioned above.

Figure 2B:
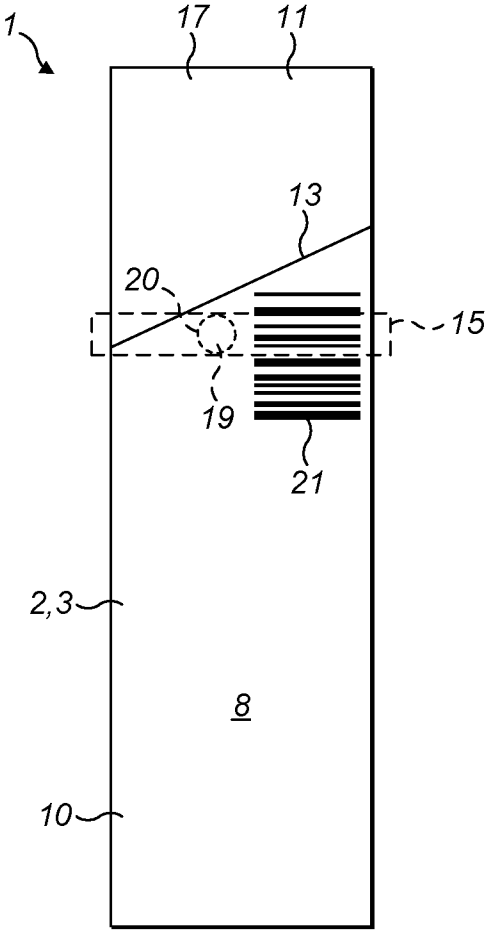
FIGS. 2A and 2B show examples of a tamper evident feature of the packaging of FIG. 1.
Figure 2A:
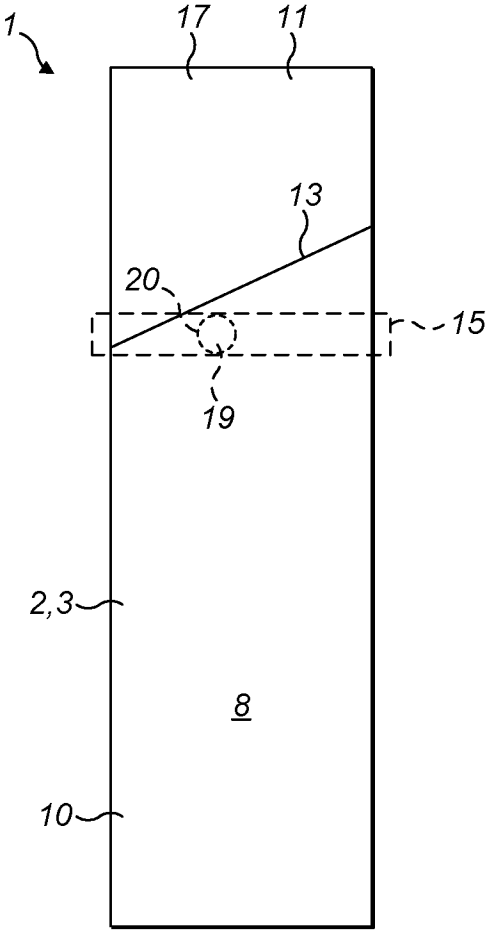

As shown in FIG. 2A, a first example of a tamper evident feature of the packaging of FIG. 1 is a detachable portion 19 of the pack 2. In this example, the pack 2 comprises the detachable portion 19, which is removed together with the tear tape 15 and/or removable portion 17 of the outer wrapper 3.

In this example, the detachable portion 19 is a part of the pack 2, in particular a part of the material of the pack 2. The detachable portion 19 is preferably attached to outer wrapper 3 and/or tear tape 15 by an adhesive, for example a hot melt adhesive or a pressure sensitive adhesive. Alternatively, the detachable portion 19 may be attached to outer wrapper 3 and/or tear tape 15 by a heat seal or an ultrasonic weld.

In one example, the detachable portion 19 is a part of the pack 2 defined by a line of weakness, such as a line of perforations 20, as illustrated in FIG. 2A. Alternatively, the line of weakness may be a score line or other weakening in the material of the pack 2. The line of weakness can be continuous or discontinuous, and can extend fully or partially through the material of the pack 2, as explained hereinafter.

The line of weakness 20 is broken as the removable portion 17 of the outer wrapper 3 is removed, detaching the detachable portion 19, which remains attached to the removable portion 17. The line of weakness 20 may be arranged such that the full thickness of the material of the pack 2 is detached in the detachable portion 19, or the line of weakness 20 may be arranged such that only an outer layer or outer part of the material of the pack 2 is detached in the detachable portion 19. In a preferred example, the lines of weakness extend through only an outer layer of the material of the pack 2, so that only the outer layer is removed on pulling the tear tape 15.

In this example, the detachable portion 19 is disposed on one of the opposing side walls 8 of the pack 2. In this position, the detachable portion 19 of the pack 2 is attached to the tear tape 15. However, in alternative examples the detachable portion 19 can be disposed on another part of the pack 2 underlying the tear tape 15 and be attached to the tear tape 15.

Alternatively, the detachable portion 19 may be disposed on another part of the pack 2 underlying the removable portion 17 of the outer wrapper 3, and in these examples the detachable portion 19 can be attached to the removable portion 17 of the outer wrapper 3, rather than the tear tape 15.

Absence of the detachable portion 19 from the pack 2 indicates to the user that the removable portion 17 of the outer wrapper 3 has previously been removed. In some examples, an underneath layer of the pack 2, which in examples is exposed on detachment of the detachable portion 19, has an indicium. For example, the underneath layer may have a different colour to the outer surface of the pack 2, such as red, or the underneath layer may have a printed mark. The indicium can indicate to the user that the removable portion 17 of the outer wrapper 3 has previously been removed.

As shown in FIG. 2B, in some examples the opposing side face 8 of the pack 2 includes a bar code 21 or other indicia, such as branding or product information. In these examples, it may be preferable to dispose the detachable portion 19 adjacent to the indicia 21 so that no part of the indicia 21 is removed from the pack 2 when the detachable portion 17 is detached. The detachable portion 19 can be located closer to the front face 4 of the pack 2 than the rear face 5 of the pack 2.

Figure 3C:
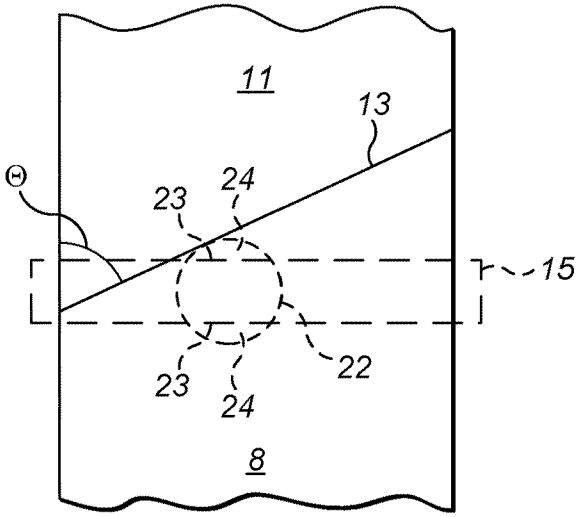
FIG. 3C shows an enlarged view of the tamper evident feature of FIGS. 3A and 3B.
Figure 3B:
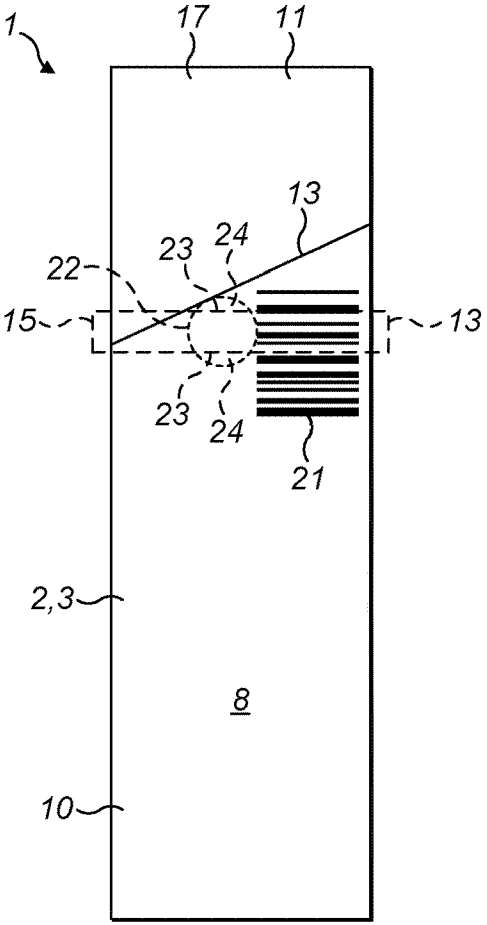
FIGS. 3A and 3B show further examples of a tamper evident feature of the packaging of FIG. 1.
Figure 3A:
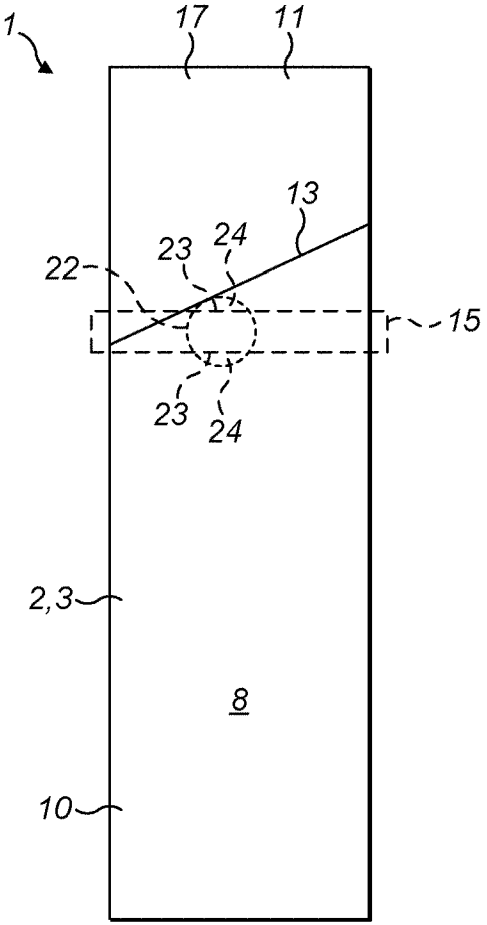

In the example of FIG. 3A the tamper evident feature is a part of the tear tape 15, shown enlarged in FIG. 3C. The tear tape 15 is attached to the outer wrapper 3 such that pulling the tear tape 15 separates the outer wrapper 3 along a line defined by the tear tape 15. In this example, the tear tape 15 comprises an enlarged portion 22 that is attached to the pack 2, for example by adhesive or heat sealing. The enlarged portion 22 comprises at least one line of weakness 23, in this example two lines of weakness 23. The lines of weakness 23 are aligned with the direction of the tear tape, 15 so that when the tear tape 15 is removed the lines of weakness 23 are broken and detachable portions 24 of the enlarged portion 22 remain attached to the pack 2.

In this example, the enlarged portion 22 and lines of weakness 23 define two detachable portions 24 of the tear tape 25 that detach from the tear tape 15 and remain attached to the pack 2 on removal of the removable portion 17 of the outer wrapper 3. In other examples, the tear tape 15 may include only a single detachable portion 24, or more than two detachable portions 24. The detachable portion(s) 24 may be disposed at any location along the tear tape 15, and in the illustrated example the detachable portion(s) 24 are disposed on the side face 8 of the pack 2.

As illustrated, in this example the enlarged portion 22 is circular, but may be a different shape, for example square or triangular. In this example the detachable portions 24 are segments of the circular enlarged portion 22, but in alternative examples can be any shape.

Presence of the detachable portions 24 of the tear tape 15 on the pack 2 indicate to a user that the removable portion 17 of the outer wrapper 3 has previously been removed. In examples, the detachable portions 24 of the enlarged portion 22 that separate from the tear tape 15 may have an indicium. For example, the detachable portions 24 may be a different colour to the pack 2, so that the user can more easily see them, or may include some printed mark to indicate that the removable portion 17 of the outer wrapper 3 has previously been removed.

As shown in FIG. 3B, and similarly to as described with reference to FIG. 2B, the tamper evident feature, in this example the enlarged portion 22 of the tear tape 15, is preferably located so that it does not obstruct or damage indicia 21 on the pack 2, such as a bar code, branding, or other printed information. The detachable portion 19 can be located closer to the front face 4 of the pack 2 than the rear face 5 of the pack 2.

In some embodiments of the packs 2 shown in FIGS. 2A, 2B, 3A, 3B and 3C the lid closure line 13 on either or both opposing side faces 8, 9 of the pack 2 may be adapted to provide additional space for the tamper evident feature. For instance, the lid closure line 13 may be provided with a curved or stepped profile to extend around the tamper evident feature, or may have a steeper angle, such as and angle Θ of less than 55 degrees, less than 52 degrees, or less than 50 degrees between the lid closure line 13 and the front face 4 of the pack 2, as shown in FIG. 3C.

Figures 4A, 4B, 4C:
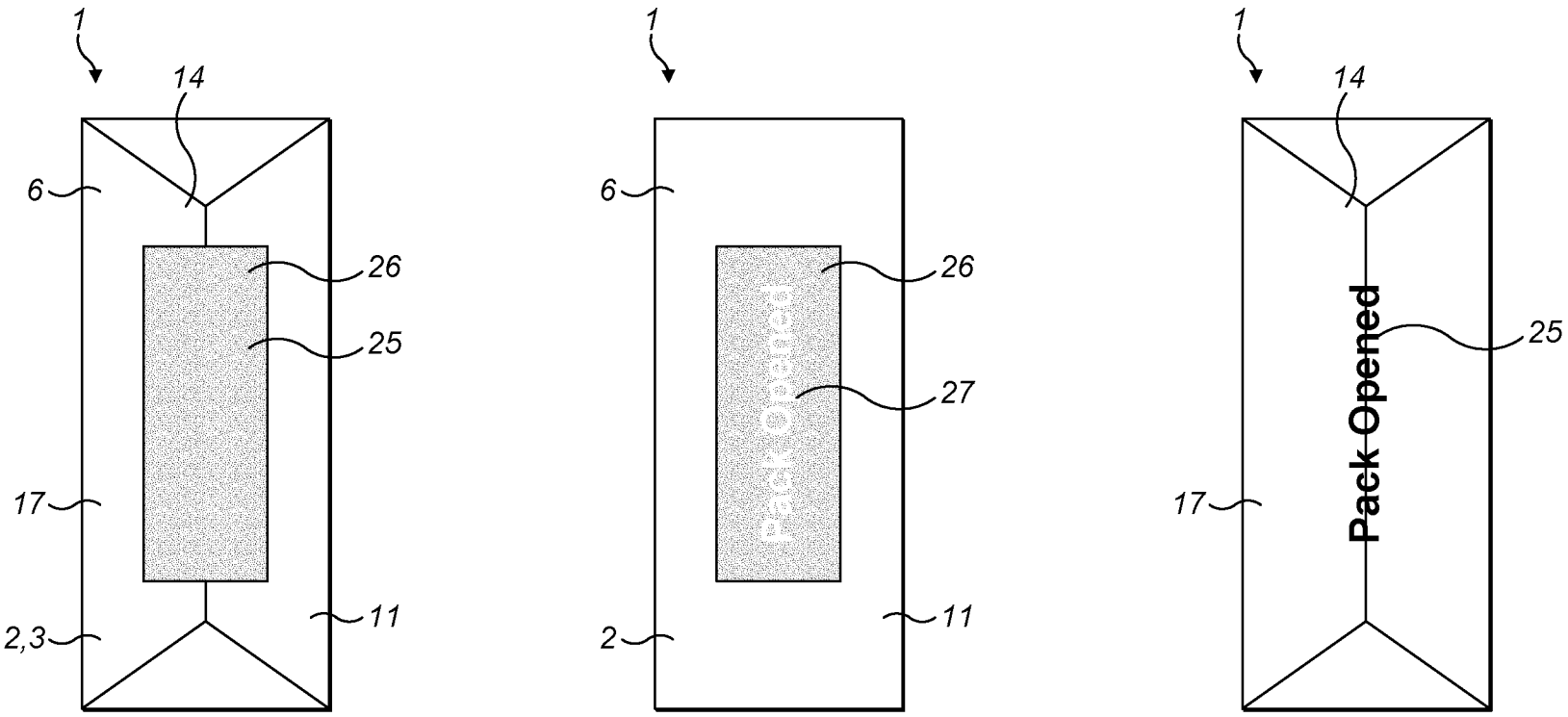
FIGS. 4A, 4B and 4C show another example of a tamper evident feature of the packaging of FIG. 1 and, FIGS. 5A and 5B show a further example of a tamper evident feature of the packaging of FIG. 1.

In the example of FIG. 4A the packaging 1 is provided with a heat activated ink 25 that is printed onto the pack 2 and is also attached to the removable portion 17 of the outer wrapper 3. In particular, in this example, a heat activated ink 25 is printed onto the end face 6 of the pack 2 forming part of the lid 11. The heat sealing process of sealing the outer wrapper 3 about the pack 2 causes the heat activated ink 25 to be attached to the outer wrapper 3.

Specifically, when the end seals 14 are formed in the outer wrapper 3, as described with reference to FIG. 1, a heated plate or heater bar is pressed against the folded ends of the outer wrapper 3 to form the heat seal 14. This also applies heat to the heat activated ink 25 printed on the end face 6 of the pack 2, causing the heat activated ink 25 to bond to the outer wrapper 3, providing an attachment between the pack 2 and the removable portion 17 of the outer wrapper 3.

In other examples the heat activated ink 25 may be disposed on any part of the pack 2 underlying the removable portion 17 of the outer wrapper 3, and a separate heat-applying process can be used to activate the heat activated ink 25 to create the attachment of the heat activated ink 25 to the removable portion 17 of the outer wrapper 3.

When the removable portion 17 of the outer wrapper 3 is removed, as previously described, the heat activated ink 25 separates from the pack 2 and remains on the removable portion 17. As illustrated, in this example the heat activated ink 25 is printed onto the end face 6 of the pack 2 in form of text, specifically "Pack Opened". However, it will be appreciated that other text or other indicia, such as a symbol or shape, can be printed onto the pack 2 instead.

In this example, the heat activated ink 25 is printed onto an area 26 that is also printed with non-heat activated ink of the same or similar colour (shown as similar in FIG. 4A for clarity), so that before the removable portion 17 of the outer wrapper 3 has been removed the text is not immediately visible. In this way, removal of the removable portion 17 of the outer wrapper 3 and the heat activated ink 25 causes the text to appear visible to the user in negative, i.e. the user can see an indicium 27 created by the absence of the heat activated ink 25 on the end face 6 of the pack 2. FIG. 4B shows the end face 6 of the pack 2 after removal of the removable portion 17 of the outer wrapper 3, including the indicium 27 created by removal of the heat activated ink 25. FIG. 4C shows the removable portion 17 of the outer wrapper 3 after removal from the pack 2, with the heat activated ink 25 present. It will be appreciated that the heat activated ink 25 can be printed in any shape or text on the pack 2.

The heat activated ink 25 preferably comprises a resin material having a low heat resistance such that it is activated by heat, and a pigment that provides the colour of the heat activated ink 25. The low heat resistance of the resin means application of heat will cause the heat activated ink 25 to adhere to the outer wrapper 3. In some examples, w depending on the materials used, a releasing primer may be printed underneath the heat activated ink 25 to aid release of the heat activated ink 25 from the pack 2. The formulation of the heat activated ink 25 can be selected such that the strength of the bond between the heat activated ink 25 and the outer wrapper 3 is greater than the strength of the bond between the heat activated ink 25 and the surface of the pack 2 on which it is printed, so is that the heat activated ink 25 remains on the removable portion 17 of the outer wrapper 3 on removal of the removable portion 17 from the packaging 1.

Figure 5A:
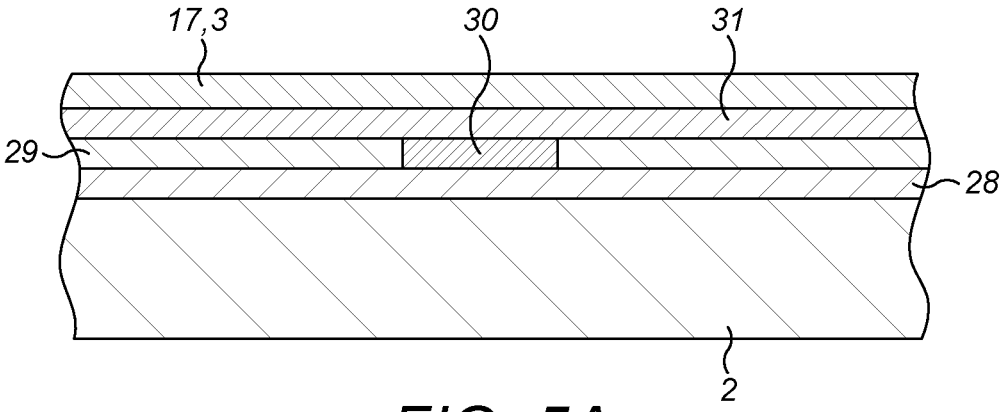
Figure 5B:
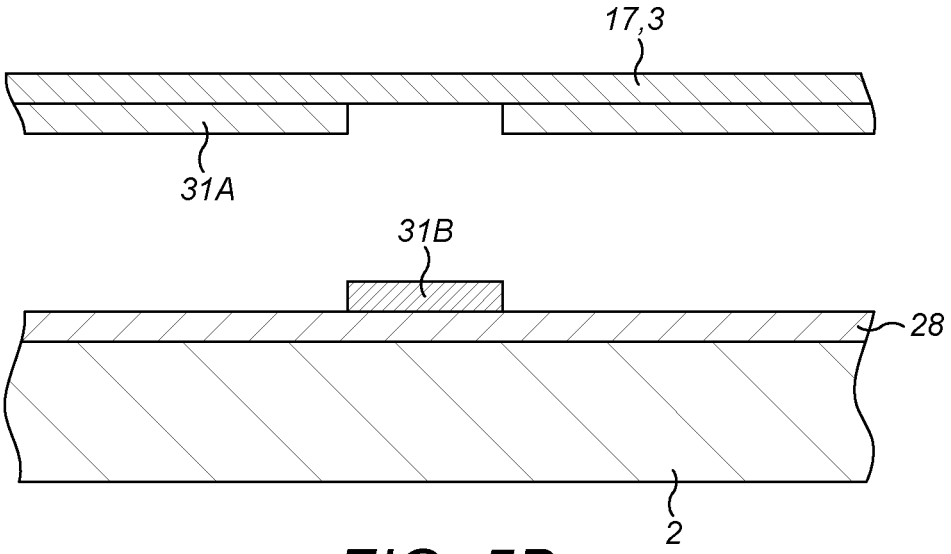

In a further example, illustrated in FIGS. 5A and 5B, the pack 2 is provided with a tamper evident feature formed by printed layers, as shown in FIG. 5A.

A printed release layer 29 is provided on the pack. The printed release layer 29 is printed in a pattern, with some areas provided with printed release layer 29 and other, spared out areas 30 that are not provided with printed release layer 29. The pattern of the printed release layer 29 is preferably a negative of an indicium, such that the spared out areas 30 form an indicium. In examples, the indicium is a message, to be visible after removal of the removable portion 17 of the outer wrapper 3, as will become apparent hereinafter.

Over the printed release layer 29 and spared out areas 30 a heat activated ink 31 is printed. Similarly to the example of FIGS. 4A to 4C, during the packaging process heat is applied to activate the heat activated ink 31. At activation, the heat activated ink 30 bonds to the removable portion 17 of the outer wrapper 3.

The printed release layer 29 preferably comprises a varnish. However, in other examples, the release layer may comprise an ink, and the ink may be pigmented or unpigmented.

Alternatively, the release layer 29 may comprise a metallic layer, for example aluminium. Preferably, the release layer 29 is not heat activated, so that it allows the described separation even after application of heat. The printed release layer 29 is preferably printed in a pattern. The printed release layer 29 preferably bonds more strongly to the card of the pack 2 than to the heat activated ink 31.

The heat activated ink 31 will bond more strongly to the card of the pack 2, through the spared out areas 30 of the printed release layer 29, than to the removable portion 17 of the outer wrapper 3.

In this way, on removal of the removable portion 17 of the outer wrapper 3, as shown in FIG. 5B, the heat activated ink 31 is separated. Areas 31A of the heat activated ink 31 corresponding to the printed release layer 29 will remain attached to the removable portion 17 of the outer wrapper 3 and are removed from the pack 2. Areas 31B of the heat activated ink 31 corresponding to the spared out areas 30 of the printed release layer 29 will remain attached to the printed ink layer 28, and will therefore remain on the pack 2.

After removal of the removable portion 17 of the outer wrapper 3 the areas 31B of the heat activated ink 31 form a pattern on the pack 2 that corresponds to the spared out areas 30 of the printed release layer 29. As mentioned above, printing the printed release layer 29 such that the spared out areas 30 form an indicium results in an indicium remaining on the pack 2 after removal of the removable portion 17 of the outer wrapper 3.

The indicium may indicate to the user that the removable portion 17 of the outer wrapper 3 has previously been removed. For example, the indicium may be text, for example text stating "Pack Opened".

In the illustrated example, the pack 2 is provided with a printed ink layer 28 as a base layer. The printed ink layer 28 may be any colour, but is preferably a neutral colour, for example grey. On removal of the heat activated ink 31 it is the printed ink layer 28 that is visible. In other examples, without the printed ink layer 28, the card is directly visible on removal of the heat activated ink 31. In this example, the printed release layer 29 preferably bonds more strongly to the printed ink layer 28 than to the heat activated ink 31.

In addition, the heat activated ink 31 preferably bonds more strongly to the printed ink layer 28 on the pack 2, through the spared out areas 30 of the printed release layer 29, than to the removable portion 17 of the outer wrapper 3.

In the example of FIGS. 5A and 5B the illustrated arrangement of layers 28, 29, 31 may be limited to a particular area of the pack 2, for example an area of an end face of the pack similarly to as shown in FIGS. 4A to 4C. Preferably, the tamper evident feature is disposed on a part of the pack 2 that is subject to heat during the packaging process, for example when heat sealing the outer wrapper 3 about the pack 2.

It will be appreciated that the thickness of the layer 28, 29, 31 as illustrated in FIGS. 5A and 5B is exaggerated for clarity. The layers 28, 29, 31 would have thicknesses in the micrometre range.

In a further example, the printed ink layer 28 may be printed in an indicium, for example a message such as "Pack Opened". Over the printed ink layer 28 the release layer 29 may be a transparent or translucent layer. The heat activated ink 31 may be printed across the entire area, and will become attached to the removable portion 17 of the outer wrapper 3. In this example, on removal of the removable portion 17 of the outer wrapper 3 the entire area of heat activated ink 31 is removed, exposing the indicium of the printed ink layer 28 through the transparent or translucent release layer 29.

It will be appreciated that the above described examples of packaging may be used to package tobacco industry products other than cigarettes. As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solid substrate.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

In order to address various issues and advance the art, the entirety of this disclosure shows by way of illustration various embodiments in which the claimed invention(s) may be practiced and provide for superior packaging for tobacco industry products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. Packaging for tobacco industry products, the packaging comprising a pack for holding tobacco industry products, and an outer wrapper enveloping the pack, the outer wrapper comprising a removable portion arranged to prevent opening of the pack until the removable portion has been removed, wherein the pack comprises a tamper evident feature that comprises a detachable portion of the pack, the detachable portion being adhered to the removable portion so that the detachable portion is detached from the pack on removal of the removable portion from the pack with the detachable portion remaining attached to the removable portion.

2. The packaging of claim 1, wherein the detachable portion is defined by a line of weakness in the pack.

3. The packaging of claim 1, wherein the detachable portion comprises a surface layer of the pack.

4. The packaging of claim 3, wherein the pack comprises an indicium located underneath the detachable portion so that the indicium is exposed on detachment of the detachable portion.

5. The packaging of claim 1, wherein the removable portion of the outer wrapper comprises a tear tape, and wherein the detachable portion is attached to a location along the tear tape.

6. The packaging of claim 1, wherein the pack comprises a body and a lid that together define a parallelepiped pack having a front face, a rear face, and opposing side faces, wherein the lid is hingedly attached to the body at a hinge extending across the rear face of the pack, and wherein the tamper evident feature is disposed on an opposing side face of the pack.

7. The packaging of claim 6, wherein the lid and the body of the pack meet at a lid closure line, and wherein the tamper evident feature is disposed adjacent the lid closure line on the opposing side face of the pack.

8. The packaging of claim 7, wherein the pack further comprises opposing end faces, and wherein the lid closure line in the opposing side faces of the pack is angled with respect to the opposing end faces.

* * * * *